US008534804B2

(12) United States Patent
Ooishi

(10) Patent No.: US 8,534,804 B2
(45) Date of Patent: Sep. 17, 2013

(54) INK-JET HEAD AND METHOD OF MANUFACTURING INK-JET HEAD

(75) Inventor: Naoki Ooishi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 12 days.

(21) Appl. No.: 13/411,729

(22) Filed: Mar. 5, 2012

(65) Prior Publication Data

US 2012/0229574 A1 Sep. 13, 2012

(30) Foreign Application Priority Data

Mar. 11, 2011 (JP) ..... 2011-054384

(51) Int. Cl.
*B41J 2/045* (2006.01)

(52) U.S. Cl.
USPC ..... 347/68

(58) Field of Classification Search
USPC ..... 347/68–72
See application file for complete search history.

(56) References Cited

U.S. PATENT DOCUMENTS 7,510,272 B2 * 3/2009 Nakamura et al. ..... 347/71
7,976,127 B2 * 7/2011 Hano et al. ..... 347/54

FOREIGN PATENT DOCUMENTS

JP 2009-202473 9/2009

* cited by examiner

*Primary Examiner* — Lamson Nguyen
(74) *Attorney, Agent, or Firm* — Turocy & Watson, LLP

(57) ABSTRACT

According to one embodiment, an ink-jet head includes a main body, electrodes, electrically conductive portions, an insulating film, an adhesive, a frame member, a lid member, an electronic component and a protective agent. The main body includes pressure chambers. The electrodes are disposed in the pressure chambers. The electrically conductive portions are disposed on the main body and connected to the electrodes. The insulating film covers the electrodes and a part of the electrically conductive portions. The adhesive covers an end portion of the insulating film. The frame member is located on the end portion of the insulating film and attached to the main body by the adhesive. The electronic component is connected to the electrically conductive portions. The protective agent covers the electrically conductive portions between the electronic component and the frame member.

18 Claims, 5 Drawing Sheets

INK-JET HEAD AND METHOD OF MANUFACTURING INK-JET HEAD

CROSS-REFERENCE TO RELATED APPLICATIONS

This application is based upon and claims the benefit of priority from the prior Japanese Patent Application No. 2011-054384, filed on Mar. 11, 2011, the entire contents of which are incorporated herein by reference.

FIELD

Embodiments described herein relate generally to an ink-jet head and a method of manufacturing the ink-jet head.

BACKGROUND

An ink-jet head comprises a substrate and a piezoelectric member mounted on the substrate. The piezoelectric member comprises a plurality of groove-like pressure chambers to be supplied with ink. Electrodes are disposed in the pressure chambers, individually, and are connected individually to a plurality of electrical traces on the substrate. A driver IC for controlling the ink-jet head is connected to the electrical traces. If the driver IC applies voltage to the electrodes in the pressure chambers through the electrical traces, the piezoelectric member undergoes a shear-mode deformation such that the ink in the pressure chambers can be ejected.

To prevent corrosion of electrically conductive portions or a short circuit, an insulating film is formed on the electrodes in the pressure chambers and the electrical traces on the substrate. In forming the insulating film, those portions to which the driver IC is connected are masked with, for example, grease.

After the insulating film is formed, that part of it located on the grease is removed. The driver IC is connected to the electrical traces exposed by the masking. On the other hand, the electrical traces are left exposed between the driver IC and an end portion of the insulating film. Thus, exposed parts of the electrical traces may be degraded.

DETAILED DESCRIPTION

In general, according to one embodiment, an ink-jet head includes a main body, a plurality of electrodes, a plurality of electrically conductive portions, an insulating film, an adhesive, a frame member, a lid member, an electronic component and a protective agent. The main body includes a plurality of pressure chambers. The electrodes are disposed in the pressure chambers, individually. The electrically conductive portions are disposed on the main body and connected to the electrodes, individually. The insulating film covers the electrodes and a part of the electrically conductive portions. The adhesive covers an end portion of the insulating film. The frame member inside which an ink chamber communicating with the pressure chambers is defined is located on the end portion of the insulating film and attached to the main body by the adhesive. The lid member is mounted on the frame member and closes the ink chamber. The electronic component is connected to the electrically conductive portions. The protective agent covers the electrically conductive portions between the electronic component and the frame member.

Figure 1:
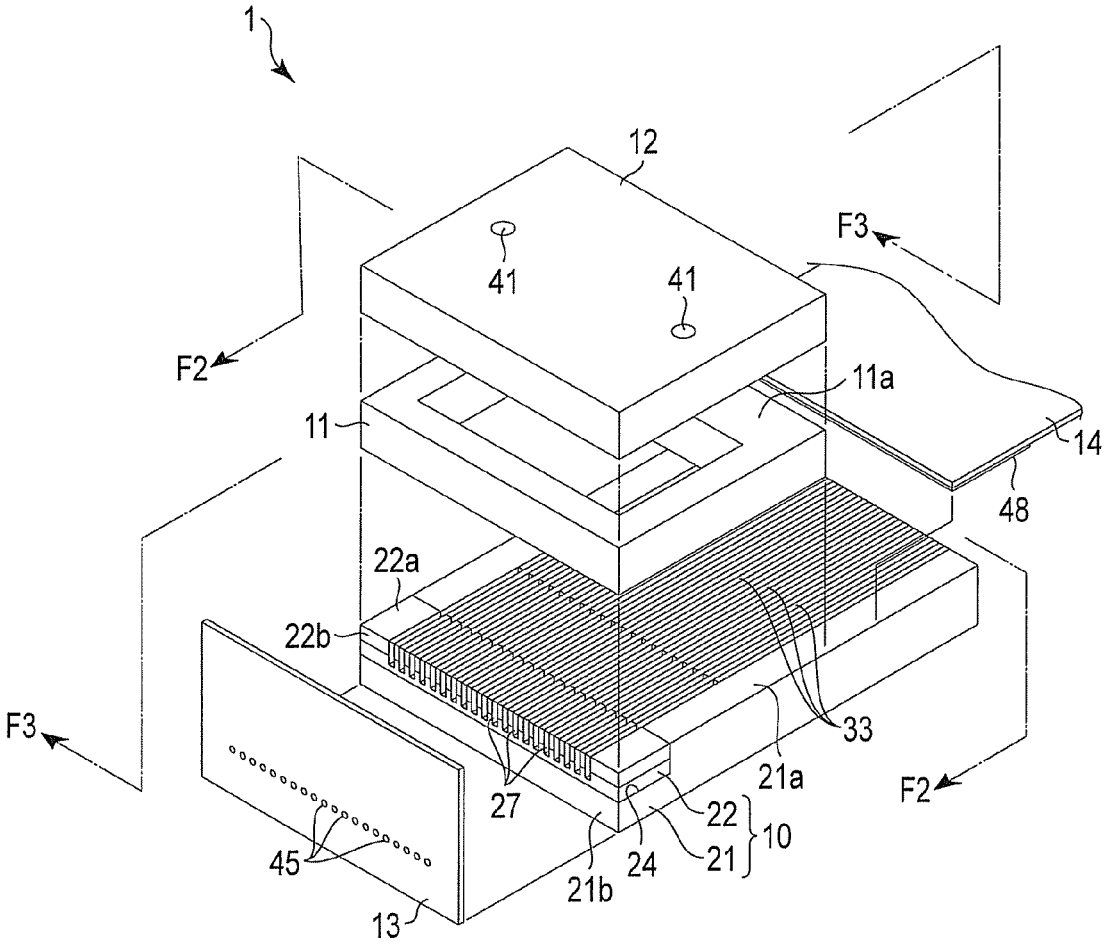
FIG. 1 is an exploded perspective view showing an ink-jet head according to a first embodiment.
Figure 2:
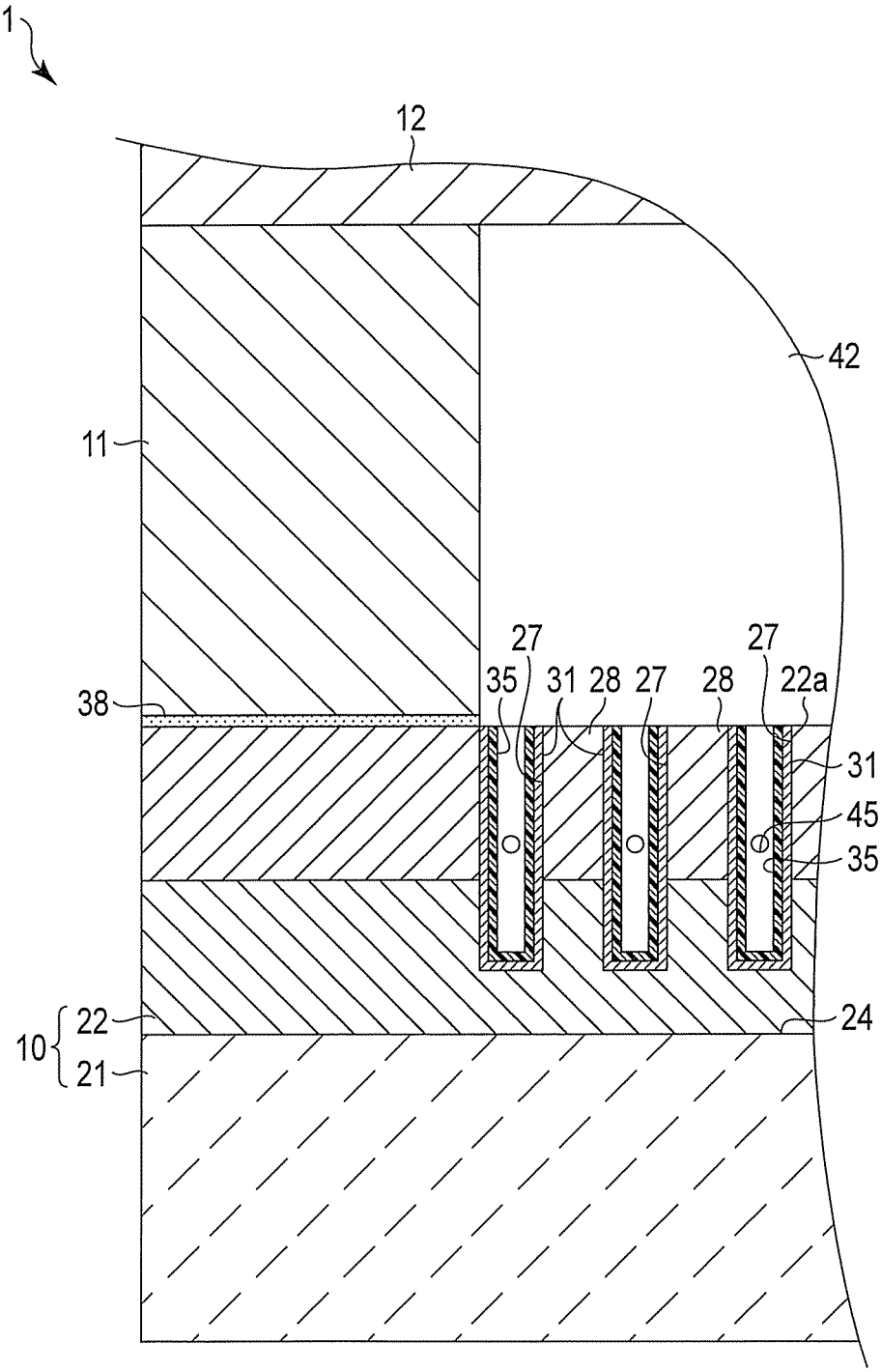
FIG. 2 is a sectional view of the ink-jet head of the first embodiment taken along line F2-F2 of FIG. 1.
Figure 3:
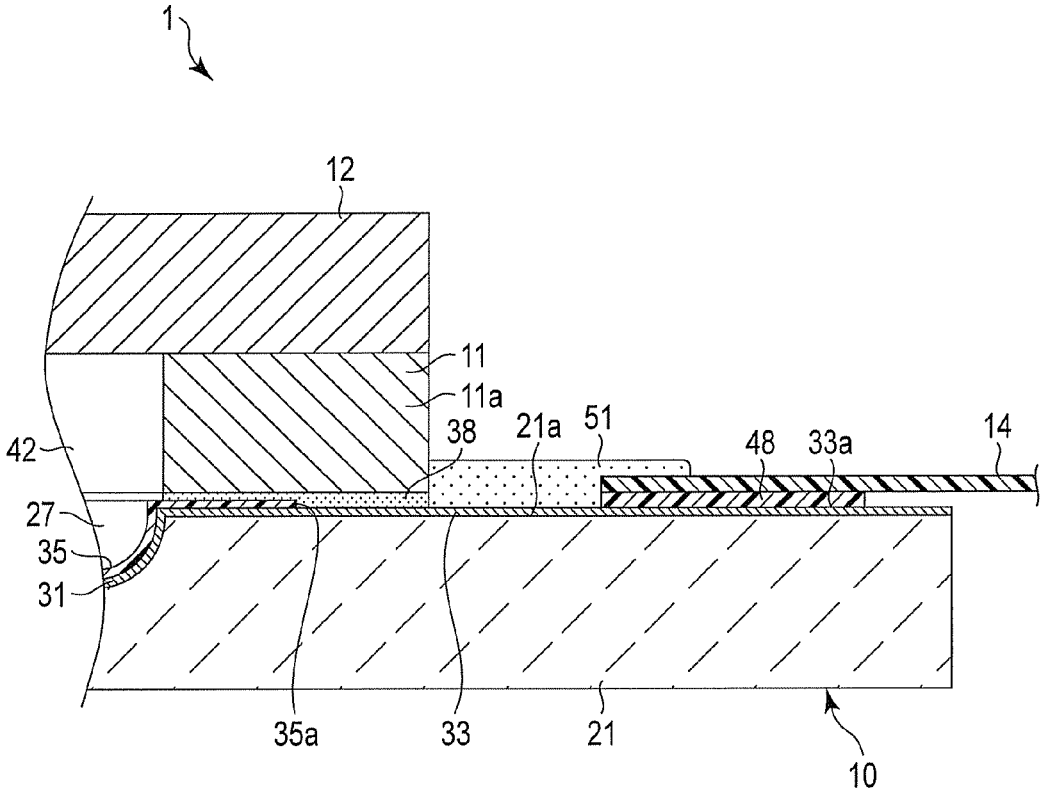
FIG. 3 is a sectional view of the ink-jet head of the first embodiment taken along line F3-F3 of FIG. 1.

A first embodiment will now be described with reference to FIGS. 1 to 3. FIG. 1 is an exploded perspective view showing an ink-jet head 1. FIG. 2 is a partial sectional view of the head 1 taken along line F2-F2 of FIG. 1. FIG. 3 is a partial sectional view of the head 1 taken along line F3-F3 of FIG. 1.

As shown in FIG. 1, the ink-jet head 1 of the first embodiment is of a so-called end-shooter type. The head 1 comprises a main body 10, frame member 11, lid member 12, nozzle plate 13, and driver IC 14. The driver IC 14 is an example of an electronic component.

The main body 10 comprises a substrate 21 and piezoelectric member 22. The substrate 21 is in the form of a rectangular plate. The substrate 21 comprises a notch portion 24 ranging from an upper surface 21*a* to a front surface 21*b* of the substrate 21.

The piezoelectric member 22 is formed by affixing two piezoelectric plates of, for example, lead zirconate titanate (PZT) together such that their polarization directions are opposite. The piezoelectric member 22 is attached to the notch portion 24 of the substrate 21.

The main body 10 comprises a plurality of pressure chambers 27 into which ink is introduced. The pressure chambers 27, each in the form of a groove, are arranged side by side and parallel to one another. These chambers 27 are located ranging from the substrate 21 to the piezoelectric member 22. The pressure chambers 27 open in the upper surface 21*a* of the substrate 21 and upper and front surfaces 22*a* and 22*b* of the piezoelectric member 22.

As shown in FIG. 2, column portions 28 are formed individually between the pressure chambers 27. The column portions 28 divide the pressure chambers 27 and form side surfaces of the pressure chambers 27, individually.

Electrodes 31 are disposed in the pressure chambers 27, individually. Each electrode 31 covers the side and bottom surfaces of its corresponding pressure chamber 27. Although each electrode 31 is formed of, for example, a thin nickel film, it may alternatively be formed of a gold or copper film, for example. Each electrode 31 is, for example, 2 to 5 μm thick. The column portions 28, having the electrodes 31 formed on their opposite side surfaces, are used as driving elements.

As shown in FIG. 1, a plurality of electrical traces 33 are arranged on the upper surface 21*a* of the substrate 21. Each electrical trace 33 is an example of an electrically conductive portion. The electrical traces 33 are formed by, for example, laser-patterning a thin nickel film formed on the upper surface 21*a* of the substrate 21. Each electrical trace 33 is, for example, 2 to 5 μm thick. The electrical traces 33 individually extend from the rear end of the upper surface 21*a* of the substrate 21. One end of each electrical trace 33 is connected to its corresponding electrode 31.

As shown in FIG. 3, an insulating film 35, which is electrically insulating and resistant to ink, is disposed on the main body 10. The insulating film 35 (not shown in FIG. 1) covers the electrodes 31, part of the electrical traces 33, part of the upper surface 21*a* of the substrate 21, and upper surface 22*a* of the piezoelectric member 22. The insulating film 35 may be configured to cover some other portion or portions, such as the front surface 21*b* of the substrate 21. The insulating film 35 is, for example, 3 to 10 μm thick. The electrodes 31 are protected by the insulating film 35 from ink introduced into the pressure chambers 27.

The insulating film 35 is cut at the rear part of the upper surface 21*a* of the substrate 21. Thus, each electrical trace 33 comprises an exposed portion 33*a* that is exposed by virtue of not being covered by the insulating film 35. The exposed portion 33*a* defines that part of the electrical trace 33 which is not covered by the insulating film 35, and can be covered by some member other than the insulating film 35.

The insulating film 35 consists mainly of, for example, a para-xylene polymer. Specifically, a para-xylylene polymer, such as Parylene-C (poly-chloro-para-xylylene), Parylene-N (poly-para-xylylene), or Parylene-D (poly-dichloro-para-xylylene), is available as this polymer material. Alternatively, the insulating film 35 may be formed using some other material, such as polyimide.

The frame member 11 is attached to the main body 10 using an adhesive 38. A beam portion 11*a* on the rear side of the frame member 11 is located on an end portion 35*a* of the insulating film 35 where the insulating film 35 is cut. As shown in FIG. 3, the end portion 35*a* of the insulating film 35 is located below the transverse central part of the beam portion 11*a* of the frame member 11.

The adhesive 38 is sandwiched between the main body 10 and frame member 11. The adhesive 38 is, for example, 30 μm thick. For example, the adhesive 38 is an epoxy-resin adhesive, which is resistant to ink and thermosetting. Alternatively, the adhesive 38 may be, for example, a silicone or acrylic adhesive. The resistance of the adhesive to ink implies that the adhesive strength can be kept at 50 kg/cm$^2$ even when the adhesive is immersed in ink for an assumed period of use of 6 to 12 months.

The adhesive 38 covers and seals the end portion 35*a* of the insulating film 35. A difference in level produced by the electrical traces 33 and insulating film 35 is made up for by the adhesive 38.

The lid member 12 is mounted on the frame member 11. As shown in FIG. 1, the lid member 12 comprises two ink supply ports 41. The frame member 11 and lid member 12, thus combined together, close the pressure chambers 27 from the side of the upper surface 21*a* of the substrate 21.

As shown in FIG. 3, an ink chamber 42 to be supplied with ink is defined inside the frame member 11 and lid member 12. The lid member 12 closes the ink chamber 42 by being mounted on the frame member 11. The ink supply ports 41 open into the ink chamber 42 and are connected to an ink tank. The ink chamber 42 communicates with the pressure chambers 27. The ink introduced into the ink chamber 42 through the ink supply ports 41 is delivered to the pressure chambers 27.

The nozzle plate 13 is formed of a rectangular film of polyimide. The nozzle plate 13 may be formed from a material other than polyimide that can undergo laser micro-processing. The nozzle plate 13 is mounted on the main body 10, frame member 11, and lid member 12. As shown in FIG. 1, the nozzle plate 13 closes the pressure chambers 27 from the side of the front surface 22*b* of the piezoelectric member 22.

The nozzle plate 13 comprises a plurality of nozzles 45. The nozzles 45, which correspond to the pressure chambers 27, individually, are arranged side by side and longitudinally relative to the nozzle plate 13. The nozzles 45 open into the pressure chambers 27, individually.

As shown in FIG. 3, the driver IC 14 is connected to the respective exposed portions 33*a* of the electrical traces 33. The driver IC 14 is a flexible printed circuit board for controlling the ink-jet head 1. The driver IC 14 is thermocompressively bonded to the electrical traces 33 by an anisotropic conductive film (ACF) 48. Alternatively, the driver IC 14 may be connected to the electrical traces 33 by some other means than the ACF 48, such as an anisotropic conductive paste (ACP), nonconductive film (NCF), or nonconductive paste (NCP). The driver IC 14 is, for example, 35 μm thick. Likewise, the ACF 48 is 35 μm thick, for example.

Based on a signal input from a controller of an ink-jet printer, the driver IC 14 applies a voltage to the electrodes 31 through the electrical traces 33. The column portions 28 to which the voltage is applied through the electrodes 31 undergo a shear-mode deformation, thereby pressurizing the ink introduced into the pressure chambers 27. The pressurized ink is ejected from the corresponding nozzles 45.

A protective agent 51 is disposed ranging from the frame member 11 to the driver IC 14. An illustration of the protective agent 51 is omitted in FIG. 1. The protective agent 51 covers the exposed portions 33*a* of the electrical traces 33 between the frame member 11 and driver IC 14.

The protective agent 51, like the adhesive 38, for example, is an epoxy-resin adhesive resistant to ink and thermosetting. Alternatively, the protective agent 51 may be, for example, a silicone or acrylic adhesive. Further, the protective agent 51 may be an adhesive of a type different from the adhesive 38.

The protective agent 51 adheres to the side surfaces of the frame member 11. Further, the protective agent 51 adheres to the driver IC 14 such that it covers a part of the IC. Thus, the protective agent 51, along with the ACF 48, secures the driver IC 14 to the main body 10.

The following is a description of an example of a method of manufacturing the ink-jet head 1 constructed in this manner. First, two piezoelectric plates are affixed to each other with, for example, a thermosetting adhesive, thereby forming the piezoelectric member 22. This piezoelectric member 22 is attached to the notch portion 24 of the substrate 21 with, for example, a thermosetting adhesive, thereby forming the main body 10.

Then, the pressure chambers 27 are formed in the main body 10. The pressure chambers 27 are defined by cutting the main body 10 by means of, for example, a diamond wheel of a dicing saw, which is used to cut IC wafers.

Subsequently, the electrodes 31 are formed in the pressure chambers 27, individually, and at the same time, the electrical traces 33 are formed on the upper surface 21*a* of the substrate 21. The electrodes 31 and electrical traces 33 are formed by, for example, electroless plating. Then, patterning is performed by, for example, laser irradiation, whereupon the thin nickel film is removed from regions other than the electrodes 31 and electrical traces 33.

Then, the insulating film 35 is formed by chemical vapor deposition (CVD). When this is done, the rear part of the upper surface 21*a* of the substrate 21 and other portions that are not covered by the insulating film 35 are protected with a masking tape, e.g., a polyimide tape. The masking tape is removed after the insulating film 35 is formed. Thus, the respective exposed portions 33*a* of the electrical traces 33 are formed that are exposed by virtue of not being covered by the insulating film 35.

After the insulating film 35 is formed, the frame member 11 is attached to the main body 10 with the adhesive 38. The adhesive 38 is applied to the frame member 11 by, for example, screen printing. The frame member 11 is bonded to the main body 10 so that its beam portion 11*a* is located above the end portion 35*a* of the insulating film 35. The end portion 35*a* of the insulating film 35 is covered by the adhesive 38. The lid member 12 is attached to the frame member 11 on the main body 10 with a thermosetting adhesive.

Then, the nozzle plate 13 that has not yet had the nozzles 45 formed in it is attached to the main body 10 with a thermosetting adhesive. An ink-repellent film is previously formed on the nozzle plate 13 by means of, for example, a bar coater. The nozzles 45 are formed by applying an excimer laser beam to the nozzle plate 13 mounted on the main body 10.

Subsequently, the driver IC 14 is thermocompressively bonded to the exposed portions 33*a* of the electrical traces 33 with the ACF 48. The driver IC 14 is electrically connected to the electrical traces 33 through the ACF 48.

Then, the protective agent 51 is applied between the driver IC 14 and frame member 11 by means of, for example, a dispenser. The respective exposed portions 33*a* of the electrical traces 33 between the frame member 11 and driver IC 14 are covered by the protective agent 51.

Thus, manufacturing processes for the ink-jet head 1 shown in FIG. 1 are accomplished. The thermosetting adhesive used in the manufacturing processes for the ink-jet head 1 may be either thermally cured every time one member is mounted or thermally cured at a time in a stage.

According to the ink-jet head 1 constructed in this manner, the end portion 35*a* of the insulating film 35 is covered by the adhesive 38. Therefore, the insulating film 35 is prevented from starting to peel off at the end portion 35*a*, or the ink from the end portion 35*a* is prevented from penetrating between the insulating film 35 and electrical traces 33. Since the adhesive 38 seals the end portion 35*a* of the insulating film 35, moreover, the ink is prevented from adhering to the end portion 35*a*.

The protective agent 51 covers the exposed portions 33*a* of the electrical traces 33 between the driver IC 14 and frame member 11. Thus, the ink is prevented from adhering to the exposed portions 33*a* even if it is introduced to the vicinity of the driver IC 14 as it leaks from an ink supply tube or creeps up during maintenance, for example. Consequently, the ink is prevented from corroding the electrical traces 33 or causing a short circuit. The conductive electrical traces 33 are protected in this way.

The protective agent 51 is an ink-resistant adhesive. Therefore, the exposed portions 33*a* of the electrical traces 33 between the driver IC 14 and frame member 11 are easily covered by applying the protective agent 51 by means of the dispenser. Since the protective agent 51 is an adhesive of the same type as the adhesive 38, moreover, an increase in the manufacturing cost of the ink-jet head 1 is suppressed.

The protective agent 51 adheres to the driver IC 14. Thus, the protective agent 51, along with the ACF 48, secures the driver IC 14 to the main body 10, thereby preventing the driver IC from separating from the electrical traces 33.

A second embodiment of the ink-jet head will now be described with reference to FIGS. 4 and 5. In the description of the embodiments to follow, like reference numbers are used to designate those constituent parts which have the same functions as their counterparts in the ink-jet head 1 of the first embodiment. Further, a description of some or all of those parts may be omitted.

Figure 4:
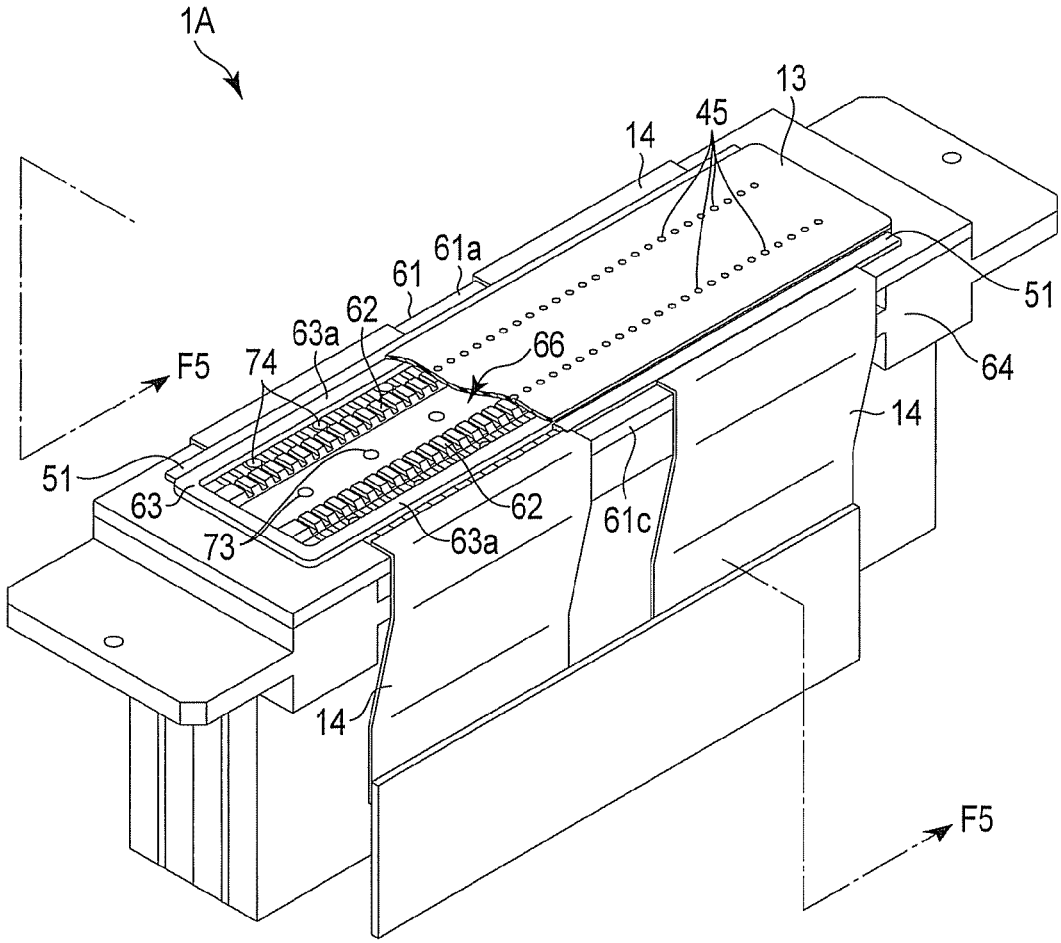
FIG. 4 is a perspective view showing an ink-jet head according to a second embodiment.
Figure 5:
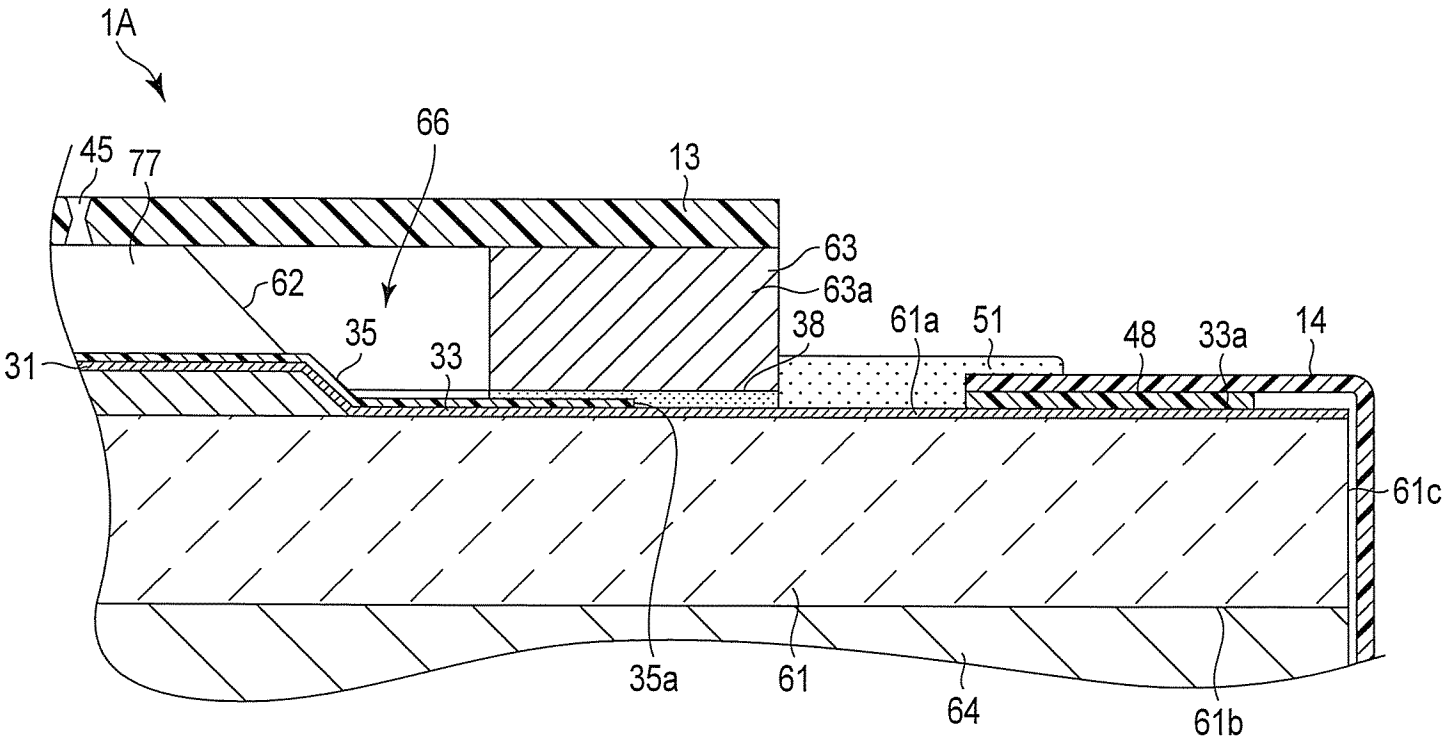
FIG. 5 is a sectional view of the ink-jet head of the second embodiment taken along line F5-F5 of FIG. 4.

FIG. 4 is a cutaway perspective view showing an ink-jet head 1A according to the second embodiment. An illustration of an insulating film 35 is omitted in FIG. 4. FIG. 5 is a partial sectional view of the ink-jet head 1A taken along line F5-F5 of FIG. 4.

As shown in FIG. 4, the ink-jet head 1A of the second embodiment is of a so-called side-shooter type. The head 1A comprises a substrate 61, a pair of piezoelectric members 62, frame member 63, nozzle plate 13, a plurality of driver ICs 14, and manifold 64. As shown in FIG. 5, an ink chamber 66 to be supplied with ink is defined inside the substrate 61, frame member 63, and nozzle plate 13. The ink chamber 66 is closed by the substrate 61 and nozzle plate 13. The pair of piezoelectric members 62 are located within the ink chamber 66.

The substrate 61 is a rectangular plate of a ceramic, such as alumina. The substrate 61 has a flat first surface 61*a* and a second surface 61*b* on the opposite side to it. The second surface 61*b* is attached to the manifold 64. As shown in FIG. 4, the substrate 61 comprises a plurality of ink supply ports 73 and a plurality of ink discharge ports 74.

The ink supply ports 73 are disposed in the central part of the substrate 61 such that they are arranged longitudinally relative to the substrate 61. The ink supply ports 73 individually open into the ink chamber 66. When the substrate 61 is attached to the manifold 64, the ink supply ports 73 are connected to an ink tank through the manifold 64. Ink in the ink tank is introduced into the ink chamber 66 through the ink supply ports 73.

The ink discharge ports 74 are arranged in two rows such that they sandwich the ink supply ports 73 between them. The ink discharge ports 74 individually open into the ink chamber 66. When the substrate 61 is attached to the manifold 64, the ink discharge ports 74 are individually connected to the ink tank through the manifold 64. The ink in the ink chamber 66 is recovered into the ink tank through the ink discharge ports 74.

The pair of piezoelectric members 62 are individually mounted on the first surface 61*a* of the substrate 61 and extend longitudinally relative to the substrate 61 and parallel to each other. The piezoelectric members 62 are individually disposed between the ink supply ports 73 and ink discharge ports 74.

Each of the piezoelectric members 62 is formed by affixing two piezoelectric plates of, for example, PZT together such that their polarization directions are opposite. Each piezoelectric member 62 is in the form of a bar having a trapezoidal cross-section.

Each piezoelectric member 62 comprises a plurality of pressure chambers 77 that communicate with the ink chamber 66. The pressure chambers 77 are grooves that extend across the piezoelectric member 62. As shown in FIG. 5, electrodes 31 are disposed in the pressure chambers 77, individually. Each electrode 31 is formed on the side and bottom surfaces of its corresponding pressure chamber 77.

A plurality of electrical traces 33 are arranged on the first surface 61*a* of the substrate 61. The electrical traces 33 are located ranging from side edges 61*c* of the substrate 61 to the piezoelectric members 62 and connected to the electrodes 31, individually.

The insulating film 35, which is electrically insulating and resistant to ink, is disposed on the substrate 61 and piezoelectric members 62. The insulating film 35 covers the electrodes 31, part of the electrical traces 33, part of the first surface 61*a* of the substrate 61, second surface 61*b* of the substrate 61, and piezoelectric members 62. The insulating film 35 may be configured to cover some other portion or portions. The electrodes 31 are protected by the insulating film 35 from ink introduced into the pressure chambers 77. Further, the electrical traces 33 are protected by the insulating film 35 from ink introduced into the ink chamber 66.

The insulating film 35 is cut in regions around the side edges 61*c* of the substrate 61. Thus, each electrical trace 33 comprises an exposed portion 33*a* that is exposed by virtue of not being covered by the insulating film 35.

The frame member 63 is attached to the first surface 61*a* of the substrate 61 using an adhesive 38. The frame member 63 surrounds the pair of piezoelectric members 62, ink supply ports 73, and ink discharge ports 74.

A beam portion 63*a* of the frame member 63 is located on an end portion 35*a* of the insulating film 35 where the insulating film 35 is cut. As shown in FIG. 5, the end portion 35*a* of the insulating film 35 is located below the transverse central part of the beam portion 63*a* of the frame member 63.

The adhesive 38 is sandwiched between the substrate 61 and frame member 63. For example, the adhesive 38 is an epoxy-resin adhesive, which is resistant to ink and thermosetting. Alternatively, the adhesive 38 may be, for example, a silicone or acrylic adhesive.

The adhesive 38 covers and seals the end portion 35*a* of the insulating film 35. A difference in level produced by the electrical traces 33 and insulating film 35 is made up for by the adhesive 38.

The nozzle plate 13 is mounted on the frame member 63. The nozzle plate 13 comprises a plurality of nozzles 45. The nozzles 45, which correspond to the pressure chambers 77, individually, are arranged side by side and open into the pressure chambers 77, individually.

The driver ICs 14 are connected to the respective exposed portions 33*a* of the electrical traces 33. The driver ICs 14 are flexible printed circuit boards for controlling the ink-jet head 1A. The driver ICs 14 are thermocompressively bonded to the electrical traces 33 by an ACF 48. Alternatively, the driver ICs 14 may be connected to the electrical traces 33 by some other means than the ACF 48, such as an ACP, NCF, or NCP.

Based on a signal input from a controller of an ink-jet printer, the driver ICs 14 apply voltage to the electrodes 31 through the electrical traces 33. The piezoelectric members 62 supplied with voltage through the electrodes 31 undergo a shear-mode deformation, thereby pressurizing the ink introduced into the pressure chambers 77. The pressurized ink is ejected from the corresponding nozzles 45.

A protective agent 51 is disposed ranging from the frame member 63 to the driver ICs 14. The protective agent 51 covers the exposed portions 33*a* of the electrical traces 33 between the frame member 63 and driver ICs 14.

The protective agent 51, like the adhesive 38, for example, is an epoxy-resin adhesive resistant to ink and thermosetting. Alternatively, the protective agent 51 may be, for example, a silicone or acrylic adhesive. Further, the protective agent 51 may be an adhesive of a type different from the adhesive 38.

The protective agent 51 adheres to the side surfaces of the frame member 63. Further, the protective agent 51 adheres to the driver ICs 14 such that it covers a part of each IC 14. Thus, the protective agent 51, along with the ACF 48, secures the driver ICs 14 to the substrate 61.

The following is a description of an example of a method of manufacturing the ink-jet head 1A constructed in this manner. First, the ink supply and discharge ports 73 and 74 are formed by press forming in the substrate 61, which is an unfired ceramic sheet (ceramic green sheet). Thereafter, the substrate 61 is fired.

Then, the pair of piezoelectric members 62 are attached to the substrate 61 with, for example, a thermosetting adhesive. The piezoelectric members 62 are positioned on the substrate 61 by means of a jig and mounted on the substrate. Subsequently, the respective corner portions of the piezoelectric members 62 are, so to speak, tapered. Thereupon, the cross-section of each piezoelectric member 62 becomes trapezoidal.

Then, the pressure chambers 77 are formed in the piezoelectric members 62. The pressure chambers 77 are defined by means of, for example, a diamond wheel of a dicing saw, which is used to cut IC wafers.

Subsequently, the electrodes 31 are formed in the pressure chambers 77, individually, and at the same time, the electrical traces 33 are formed on the first surface 61*a* of the substrate 61. The electrodes 31 and electrical traces 33 are formed from, for example, a thin nickel film by electroless plating. Then, patterning is performed by laser irradiation, whereupon the thin nickel film is removed from regions other than the electrodes 31 and electrical traces 33.

Then, the insulating film 35 is formed by CVD. When this is done, the regions around the side edges 61*c* of the first surface 61*a* of the substrate 61 and other portions that are not covered by the insulating film 35 are protected with a masking tape, e.g., a polyimide tape. The masking tape is removed after the insulating film 35 is formed. Thus, the respective exposed portions 33*a* of the electrical traces 33 are formed that are exposed by virtue of not being covered by the insulating film 35.

After the insulating film 35 is formed, the frame member 63 is attached to the substrate 61 with the adhesive 38. The adhesive 38 is applied to the frame member 63 by, for example, screen printing. The frame member 63 is bonded to the substrate 61 so that its beam portion 63*a* is located above the end portion 35*a* of the insulating film 35. The end portion 35*a* of the insulating film 35 is covered by the adhesive 38.

Then, the nozzle plate 13 that has not yet had the nozzles 45 formed in it is affixed to the piezoelectric members 62 and frame member 63. An ink-repellent film is previously formed on the nozzle plate 13 by means of, for example, a bar coater. The nozzles 45 are formed by applying an excimer laser beam to the nozzle plate 13 mounted on the frame member 63.

Subsequently, the driver ICs 14 are thermocompressively bonded to the exposed portions 33*a* of the electrical traces 33 with the ACF 48. The driver ICs 14 are electrically connected to the electrical traces 33 through the ACF 48.

Then, the protective agent 51 is applied between the driver ICs 14 and frame member 63 by means of, for example, a dispenser. The respective exposed portions 33*a* of the electrical traces 33 between the frame member 63 and driver ICs 14 are covered by the protective agent 51.

Finally, the second surface 61*b* of the substrate 61 is attached to the manifold 64, whereupon manufacturing processes for the ink-jet head 1A shown in FIG. 4 are accomplished. The thermosetting adhesive used in the manufacturing processes for the ink-jet head 1A may be either thermally cured every time one member is mounted or thermally cured at a time in a stage.

According to the ink-jet head 1A constructed in this manner, the end portion 35*a* of the insulating film 35 is covered by the adhesive 38. Therefore, the insulating film 35 is prevented from starting to peel off at the end portion 35*a*, or the ink from the end portion 35*a* is prevented from penetrating between the insulating film 35 and electrical traces 33. Since the adhesive 38 seals the end portion 35*a* of the insulating film 35, moreover, the ink is prevented from adhering to the end portion 35*a*.

The protective agent 51 covers the exposed portions 33*a* of the electrical traces 33 between the driver ICs 14 and frame member 63. Thus, the ink is prevented from adhering to the exposed portions 33*a* even if it is introduced to the vicinity of the driver ICs 14 as it leaks from an ink supply tube or creeps up during maintenance, for example. Consequently, the ink is prevented from corroding the electrical traces 33 or causing a short circuit. The conductive electrical traces 33 are protected in this way.

The protective agent 51 is an ink-resistant adhesive. Therefore, the exposed portions 33*a* of the electrical traces 33 between the driver ICs 14 and frame member 63 are easily covered. Since the protective agent 51 is an adhesive of the same type as the adhesive 38, moreover, an increase in the manufacturing cost of the ink-jet head 1A is suppressed.

The protective agent 51 adheres to the driver ICs 14. Thus, the protective agent 51, along with the ACF 48, secures the driver ICs 14 to the main body 10, thereby preventing the driver ICs from separating from the electrical traces 33.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink-jet head comprising:

a main body comprising a plurality of pressure chambers;

a plurality of electrodes disposed in the pressure chambers, individually;

a plurality of electrically conductive portions disposed on the main body and connected to the electrodes, individually;

an insulating film which covers the electrodes and a part of the electrically conductive portions;

an adhesive which covers an end portion of the insulating film;

a frame member inside which an ink chamber communicating with the pressure chambers is defined and which is located on the end portion of the insulating film and attached to the main body by the adhesive;

a lid member mounted on the frame member and closing the ink chamber;

an electronic component connected to the electrically conductive portions; and a protective agent which covers the electrically conductive portions between the electronic component and the frame member.

2. The ink-jet head of claim 1, wherein the end portion of the insulating film is sealed by the adhesive.

3. The ink-jet head of claim 2, wherein the protective agent is an ink-resistant adhesive.

4. The ink-jet head of claim 3, wherein the protective agent adheres to the electronic component.

5. The ink-jet head of claim 3, wherein the protective agent is an adhesive of the same type as the adhesive for the frame member.

6. The ink-jet head of claim 4, wherein the electronic component is a driver IC.

7. An ink-jet head comprising:

a substrate;

a piezoelectric member attached to the substrate and comprising a plurality of pressure chambers;

a plurality of electrodes disposed in the pressure chambers, individually;

a plurality of electrically conductive portions disposed on the substrate and connected to the electrodes, individually;

an insulating film which covers the electrodes and a part of the electrically conductive portions;

an adhesive which covers an end portion of the insulating film;

a frame member inside which an ink chamber communicating with the pressure chambers is defined and which is located on the end portion of the insulating film and attached to the main body by the adhesive;

a nozzle plate mounted on the frame member, closing the ink chamber, and comprising a plurality of nozzles opening into the pressure chambers, individually;

an electronic component connected to the electrically conductive portions; and a protective agent which covers the electrically conductive portions between the electronic component and the frame member.

8. The ink-jet head of claim 7, wherein the end portion of the insulating film is sealed by the adhesive.

9. The ink-jet head of claim 8, wherein the protective agent is an ink-resistant adhesive.

10. The ink-jet head of claim 9, wherein the protective agent adheres to the electronic component.

11. The ink-jet head of claim 9, wherein the protective agent is an adhesive of the same type as the adhesive for the frame member.

12. The ink-jet head of claim 10, wherein the electronic component is a driver IC.

13. A method of manufacturing an ink-jet head, comprising:

covering a part of an electrically conductive portion, which is disposed on a main body and connected to an electrode in a pressure chamber, with an insulating film;

bonding a frame member, inside which an ink chamber is defined, to the main body so that an adhesive covers an end portion of the insulating film;

connecting an electronic component to an exposed part of the electrically conductive portion; and covering the electrically conductive portion between the frame member and the electronic component with a protective agent.

14. The method of manufacturing an ink-jet head of claim 13, wherein the end portion of the insulating film is sealed with the adhesive.

15. The method of manufacturing an ink-jet head of claim 14, wherein the protective agent is an ink-resistant adhesive.

16. The method of manufacturing an ink-jet head of claim 15, wherein the protective agent is adhered to the electronic component.

17. The method of manufacturing an ink-jet head of claim 15, wherein the protective agent is an adhesive of the same type as the adhesive for the frame member.

18. The method of manufacturing an ink-jet head of claim 16, wherein the electronic component is a driver IC.

* * * * *